United States Patent [19]

Offutt et al.

[11] 4,369,897

[45] Jan. 25, 1983

[54] PRODUCT STORING AND DISPENSING APPARATUS

[75] Inventors: Elmer B. Offutt, Independence; Edward Babich, Kansas City, both of Mo.; William G. Gillett, Kansas City, Kans.

[73] Assignee: Fawn Engineering Corp., Des Moines, Iowa

[21] Appl. No.: 199,747

[22] Filed: Oct. 23, 1980

[51] Int. Cl.[3] ..... B65H 1/12

[52] U.S. Cl. ..... 221/227; 221/232

[58] Field of Search ..... 221/227, 230, 232, 226, 221/125, 129, 273

[56] References Cited

U.S. PATENT DOCUMENTS

| | | | |
|---|---|---|---|
| 3,653,540 | 4/1972 | Offutt | 221/75 |
| 3,737,071 | 6/1973 | Offutt et al. | 221/129 |
| 4,043,483 | 8/1977 | Gore et al. | 221/155 |
| 4,113,140 | 9/1978 | Graef et al. | 221/227 X |

*Primary Examiner*—Stanley H. Tollberg
*Attorney, Agent, or Firm*—Henderson & Sturm

[57] ABSTRACT

Product storing and dispensing apparatus for the improved handling of products such as gum and mints is provided and especially suited for use in multi-product, selective vending machines of types that store and dispense a variety of products from compartmented drawers, which must be withdrawn for practical reloading with products. The improved apparatus conserves space and minimizes the weight of the structure to be moved during loading by substituting for the conventional drawer unit a lower assembly that carries the operating mechanism for selective product dispensing and may remain within the machine during loading and an upper assembly that merely receives products, is shiftably mounted on the lower assembly and alone need be withdrawn during loading. The loading operation is further improved by eliminating the conventional, overhanging, product hold-down flanges along the sides of the product compartments and substituting therefor a hinged, plate-like cover that is also rearwardly and forwardly shiftable to facilitate reliable latching and unlatching thereof. Loading is still further enhanced by a construction providing automatic removal of product pusher forces during withdrawal of the upper assembly for loading and automatic restoration thereof when the upper assembly is moved back into its normal operating position. Selective product ejector mechanisms of a new and simplified construction especially adapted for employment with the upper and lower assembly arrangement of the improved apparatus are also incorporated in the latter.

14 Claims, 6 Drawing Figures

PRODUCT STORING AND DISPENSING APPARATUS

BACKGROUND OF THE INVENTION

1. Field of the Invention

This invention relates to product storing and dispensing apparatus adapted for use in vending machines and, more particularly, to improved apparatus of that kind, which is especially suited for handling products having relatively rigid, symmetrical forms, such as packages of gum, mints or the like, and for doing so, if desired, in the environment of a drawer type, selective vending machine in which other forms of products may be handled with different classes of storage and dispensing apparatus appropriate to their characteristics, such as those employing helix type dispensing mechanisms for handling bag packaged products or the like.

2. Description of the Prior Art

Vending machines of the general class disclosed in the Offutt U.S. Pat. No. 3,635,540 have become increasingly popular with both operators thereof and customers of the vendable products marketed therefrom by virtue of the ability of the helix type dispensing mechanisms employed in such machines to handle a wide variety of product types including non-rigid and irregularly shaped items such as bagged potato chips and the like, the manner in which such machines naturally display to customers the next-to-be-dispensed product from each of the stored supplies of a number of different product types that are available on a selectable basis, and the convenience afforded operators in reloading the withdrawable drawers of such machines with products.

It has since been recognized, however, that, although it is desirable to be able to offer a variety of products also including so-called "flat pack" items such as gum, cigarettes or the like and so-called "roll pack" items such as mints or the like from such machines, and although helix type dispensing mechanisms can be employed to handle the latter types of products, helix mechanisms inherently limit the number of flat pack and roll pack products that can be stored in a compartment of given length to an extent which is significantly less efficient than side-by-side, row storage for which such products are naturally adapted. Accordingly, efforts have previously been directed to developing various product storing and dispensing arrangements for more efficiently handling flat pack and roll pack products in the environment of vending machines otherwise employing helix equipped drawers for handling other types of products, as exemplified and probably typified by the Offutt et al U.S. Pat. No. 3,737,071 and the Gore et al U.S. Pat. No. 4,043,483.

Such mentioned prior devices have certainly proved entirely practical and to achieve advantages of their own over what had previously been available. However, those and all other prior devices for the same purpose of which we are aware were subject to certain limitations both with respect to efficiency of product storage where a number of varieties of products such as gum and mints of different flavors are to be accommodated and with respect to offering less than optimum convenience in product loading operations involving the mentioned types of products.

It would seem that prior efforts to provide product storing and dispensing apparatuses for gum and mints to be used in machines otherwise employing helix type mechanisms for handling other products may have been unduly influenced by a natural tendency to assume that the gum and mint handling units should differ from the neighboring helix mechanism type units to be used in the same machine as little as necessary, rather than by considerations we now recognize as being most relevant to the optimized handling of products such as gum and mints in the mentioned environment.

SUMMARY OF THE INVENTION

Accordingly, it is the broad objective of this invention to overcome the limitations of prior devices intended for use in storing and dispensing products such as gum and mints in vending equipment of the superposed drawer type from which a variety of other products are also to be offered to the customer on a selective basis. One of the more important specific aspects of that objective is to improve the overall characteristics of such apparatus with respect to reliable and convenient loading thereof with products such as gum and mints in a space saving, storage efficient arrangement. Another significant aspect of such objective is to provide a dispensing mechanism of type aptly suited for cooperative functioning with the arrangement needed for storage and loading efficiency.

It is believed that this invention achieves the mentioned objective, as well as a number of more specific advantages in fabrication and operation, by an improved construction for apparatus for storing and dispensing products such as gum and mints in which cooperating but separate assemblies are provided for receiving and storing products and for implementing the operating mechanism needed to selectively dispense an endmost product from the product receiving and storing assembly, and in which each assembly is optimized for the efficient accomplishment of the functions it is to perform. Thus, only the product receiving and storing assembly is shiftably mounted for withdrawal into a position extending out of the internal chamber of the machine during normal loading, its configuration is space and weight minimizing consistently with the relatively small transverse or height dimensions of the type of products it is to handle, its construction includes open top product compartments, a single hinged, plate-like cover rather than product hold-down flanges, a special latching arrangement for the cover, automatic relief and restoration of product pusher forces, and other refinements for facilitating loading; while the dispensing mechanism assembly need not be moved during loading of the storage assembly and employs an arrangement of components simplifying fabrication but increasing reliability in an electrically controllable selective ejector system employing a common main drive for a plurality of alternately actuatable product ejectors.

Further details of the above-mentioned and other aspects of our improved apparatus will be pointed out or become apparent to those skilled in the art from the preferred embodiment of the invention shown in the drawings and hereinafter described for illustration.

DESCRIPTION OF THE PREFERRED EMBODIMENT

Figure 2:
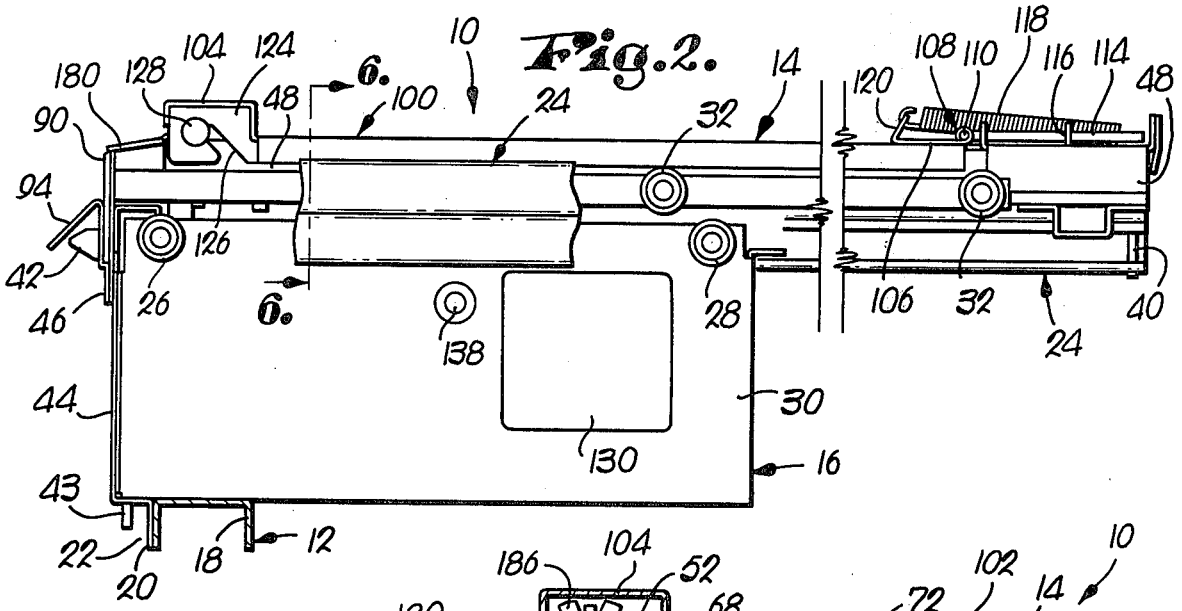
FIG. 2 is a side elevational view of the apparatus of FIG. 1, but also showing the lower or base assembly thereof within which the product dispensing mechanisms are housed and upon which the product carrying assembly is shiftably mounted.

Referring to our currently preferred embodiment of the invention, as shown in the drawings for illustration of the principles of improved construction involved, our product storing and dispensing apparatus is generally designated by the reference numeral 10, and will be understood to be adapted and intended for installation within the internal product chamber of a vending machine of the general class previously mentioned herein, which machine is represented in the drawings only by a portion of its internal structure for supporting product storing and dispensing units depicted in FIG. 2 and therein designated 12.

The apparatus 10 broadly includes a lower, base assembly 16 for mounting and housing the dispensing mechanism components hereinafter described, and an upper, product carrying assembly 14 for receiving and storing products until they are dispensed.

The internal supporting structure 12 of the host machine may be of various forms adapted for supporting and mounting an apparatus 10 within the product chamber of the machine, either by underlying framing, side supports or the like, but is depicted for simplicity in FIG. 2 as involving underlying framing such as provided by the illustrated transversely extending, inverted channel member 18 underlying the base assembly 16 and to which a flange portion 20 of the base assembly 16 may be releasably attached as by screws 22, since the base assembly 16 of the apparatus 10 may remain in fixed position during both normal operation and loading and would typically need to be removed from the machine only in the event of a need to repair the dispensing mechanism components of the assembly 16.

Figure 4:
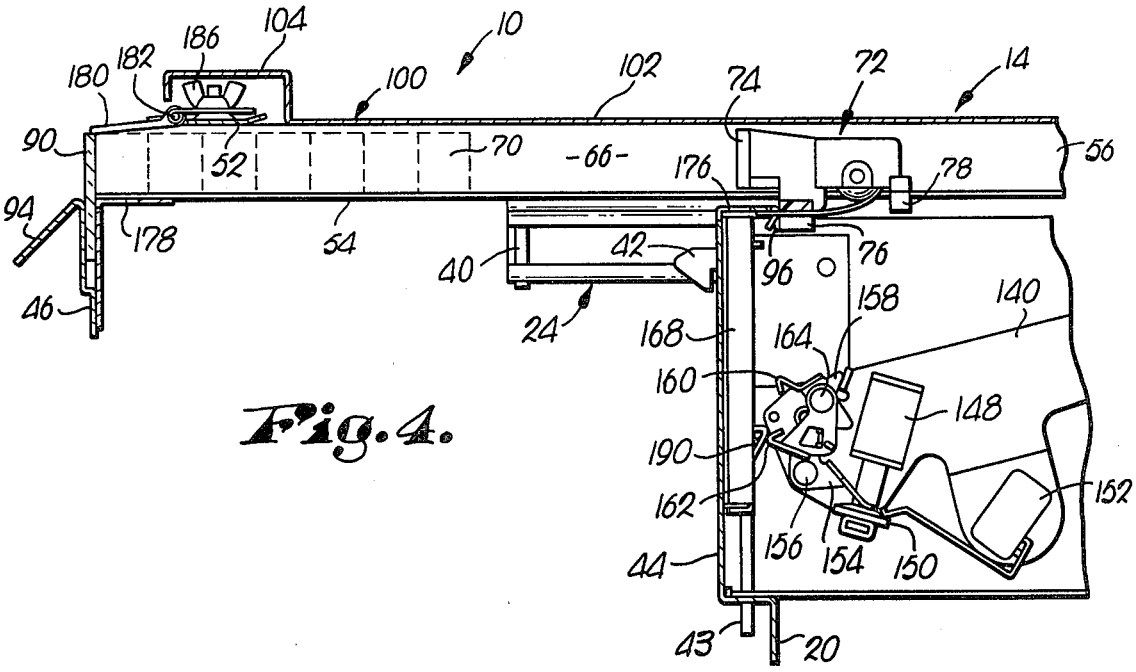
FIG. 4 is a vertical cross-sectional view of the apparatus similar to that of FIG. 3, but showing the product carrying assembly in its shifted position for loading and the depicted product dispensing mechanism in its standby condition.

As best shown in FIGS. 2 and 4, the product carrying assembly 14 is mounted for forward and rearward, horizontal movement relative to the base assembly 16 by means of a floating track arrangement generally designated 24 on each side of the assemblies 14 and 16. Each floating track assembly 24 employs a forward roller 26 and a rear roller 28 rotatably mounted on the corresponding side wall 30 of the base assembly 16, a plurality of rollers 32 rotatably mounted along the corresponding sides of the carrying assembly 14, and a double tracked, elongate guide assembly 34 having lower and upper, longitudinal track channels 36 and 38 for respectively receiving the rollers 26, 28 and the rollers 32. It will be understood that, during forward movement of the carrying assembly 14 away from its normal operating position depicted in FIG. 2 toward its loading position depicted in FIG. 4, the track assembly 24 is adapted to move or "float" forwardly within the limits provided by end pins in the track channels 36 and 38 such as shown at 40. It may be also noted while referring to FIG. 2 that a manually liftable latch 42 is mounted in any suitable fashion upon the front wall 44 of the base assembly 16 and adapted to extend through an opening (not shown) in a depending front flange 46 of the carrying assembly 14 and to releasably latch with such flange 46 for retaining the carrying assembly 14 in the normal operating position thereof depicted in FIG. 2. When it is desired to move the carrying assembly 14 to its forwardly extended loading position illustrated in FIG. 4, the service personnel need merely temporarily lift the latch 42 to release the same, and the latching engagement between the latch 42 and the flange 46 will preferably be so configured that the latching action will be automatically restored whenever the carrying assembly 14 is shifted rearwardly into its normal operating position depicted in FIG. 2. An extension rod 43 may be provided for lifting latch 42.

Figure 6:
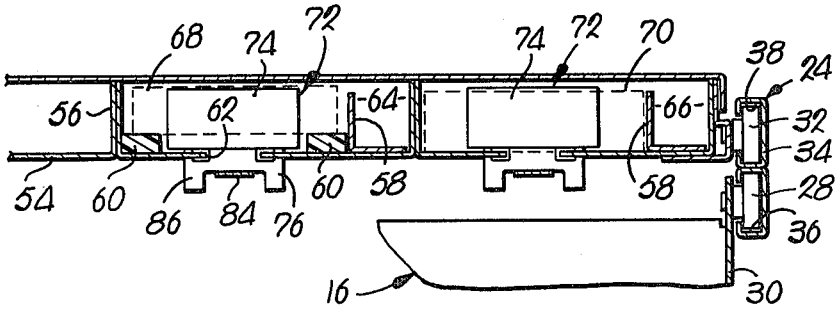
FIG. 6 is a fragmentary vertical cross-sectional view taken on line 6—6 of FIG. 2.

The upper product carrying assembly 14 includes a relatively shallow, tray-like assembly having side walls 48, a rear top piece 50 extending transverely of the assembly 14 adjacent the rear extremity thereof, a front top piece 52 extending transversely across the assembly 14 adjacent the front thereof, a bottom wall 54 and laterally spaced, upstanding, rear-to-front extending partitions 56. As best shown in FIG. 6, the bottom wall 54 and partitions 56 may be conveniently and economically fabricated by employing upwardly facing channel pieces suitably secured to each other as by spot welding or other fastening means (not shown). Whether formed by the use of such channels or by a single plate-like bottom wall with the upstanding partitions 56 suitably secured thereto at laterally spaced intervals, the bottom wall 54 is provided with a plurality of laterally spaced, elongate, rear-to-front extending slots 62, with one of such slots between each adjacent pair of upstanding partitions 56. The bottom wall 54 and the partitions 56 present a plurality of side-by-side, open-top, elongate compartments as at 64 and 66 extending in side-by-side relationship to each other and in rear-to-front relationship to the carrying assembly 14. The compartment 64 is depicted as storing generally cylindrical products such as rolls of mints 68, while the compartment 66 is depicted as handling generally parallelepipedal products such as packs of gum 70. The partitions 56 are preferably spaced so that the widths of the compartments 64 and 66 will be sufficient to accommodate the length dimension of any types of products 68 or 70 of the class to be handled; the dimensions of the effective width of the compartments 64 and 66 may then be quickly and conveniently altered by the mere insertion along one side thereof of an angle piece as at 58. Similarly, the height of the compartments 64 and 66 determined by the partitions 56 should be held to that minimum required for accommodating the height dimension of any of the products of the class to be handled, so as to minimize the space requirements of the carrying assembly 14; when that is done, however, there may be certain products, such as some types of rolls of mints 68, whose diameter would be such that the top of the products would be spaced significantly below the top of the partitions 56 and the compartments 64 or 66. In the latter case, it is desirable to utilize with such products having a small height dimension a pair of elongate spacer elements as at 60 disposed upon the bottom wall 54 along the sides of each such compartment 64 or 66 intended to accommodate products of relatively small height dimension. The spacers 60 raise the effective product supporting surfaces otherwise provided by the bottom wall 54, and serve to assure that all products 68 and 70 are so stored within the compartments 64 and 66 that their tops will be adjacently spaced only slightly below the top plane of the involved compartments 64 or 66.

Figure 1:
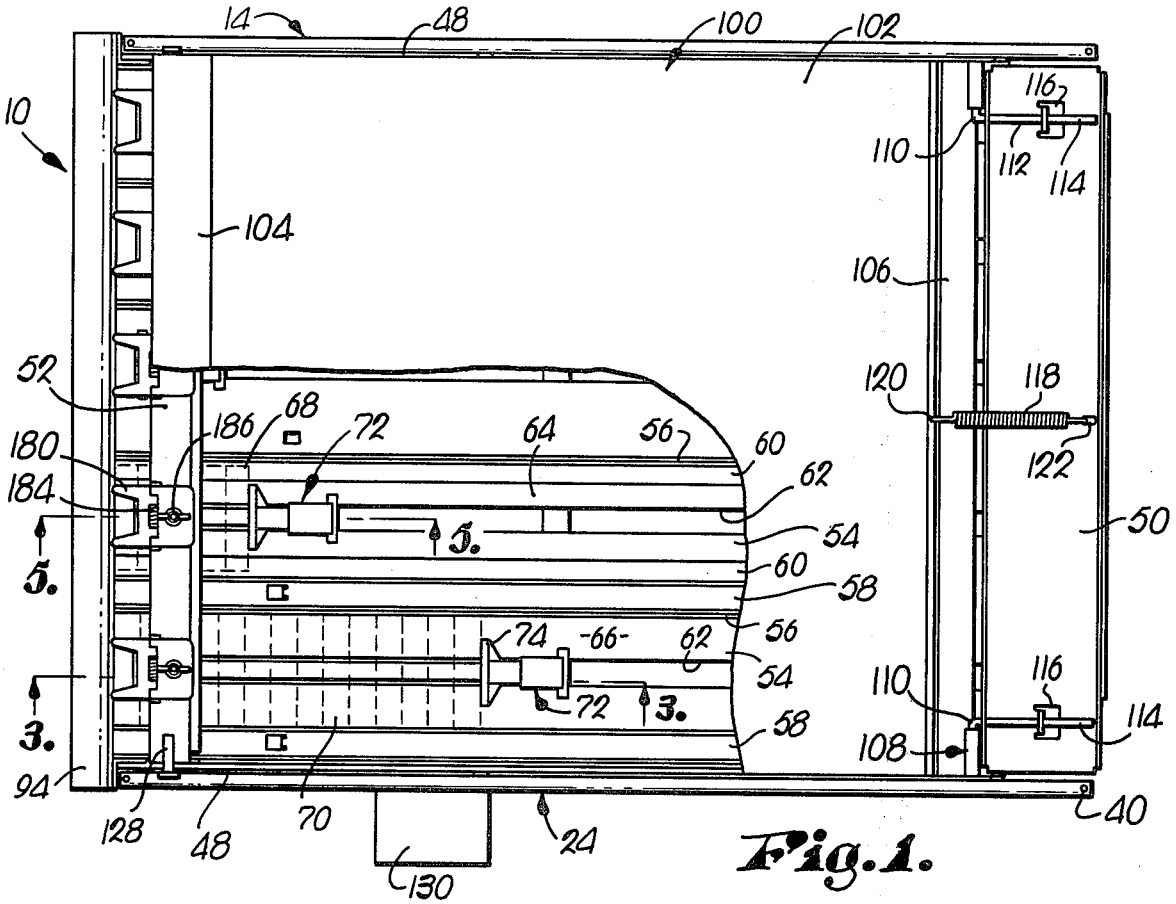
FIG. 1 is a top plan view of the upper or product carrying assembly of the currently preferred embodiment of our improved product storing and dispensing apparatus.
Figure 5:
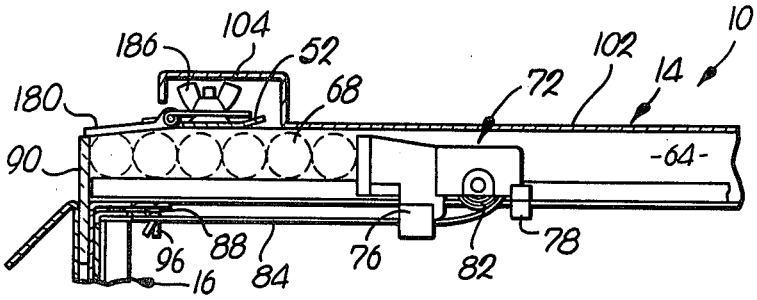
FIG. 5 is a fragmentary vertical cross-sectional view taken on line 5—5 of FIG. 1.
Figure 3:
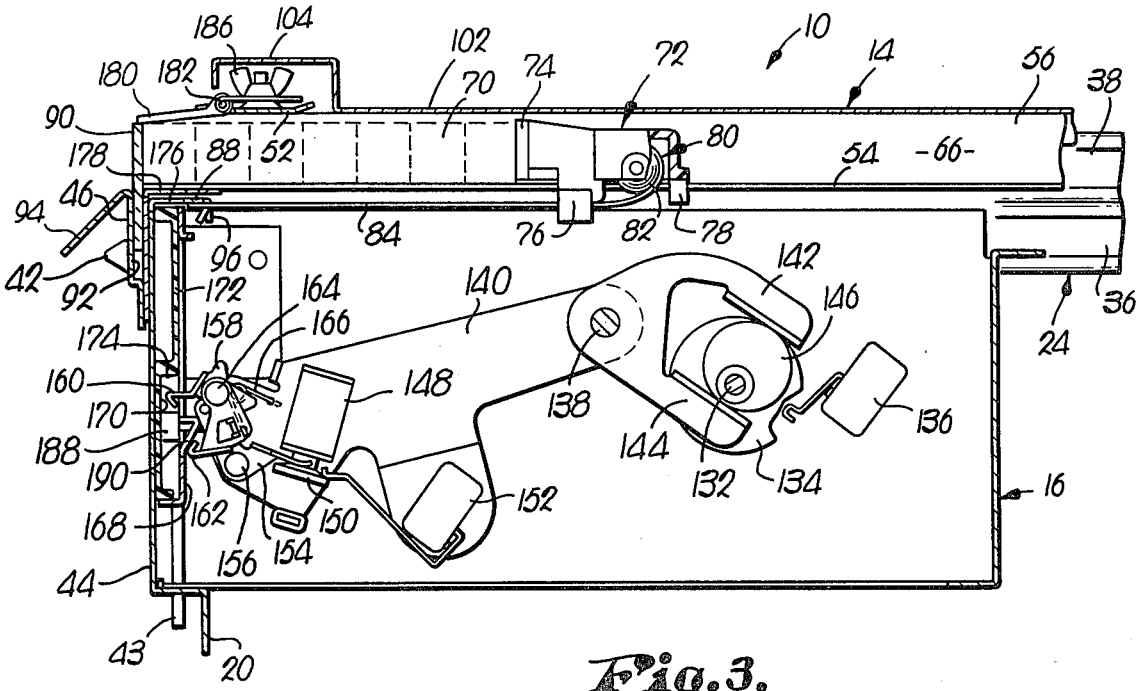
FIG. 3 is a vertical cross-sectional view of the apparatus taken on line 3—3 of FIG. 1, showing the product carrying assembly in its normal operating position and the depicted product dispensing mechanism in a selected condition ready to commence moving its ejector member upwardly to dispense the forwardmost product from the carrying assembly.

Referring to FIGS. 3, 4 and 5, along with FIG. 1, it will be seen that each of the compartments as at 64, 66 is provided with a product pusher element 72 having a flat, pivotal, frontal portion 74 for engaging the rearmost product 68 or 70 and depending front and rear projections 76 and 78 which extend downwardly through the corresponding slot 62 to guide the element 72 along the latter. A reel-type tension spring assembly 80 is provided for each of the pusher elements 72 and has its take-up reel 82 rotatably mounted on the latter and its linearly extended spring portion 84 running downwardly through the corresponding slot 62 and thence forwardly between spaced guide ears 86 on the forward projection 76 (see FIG. 6) to a point of securement of the forward distal end thereof to a flange portion 88 of the base assembly 16 adjacent the top and front of the latter. It will be understood that the spring assembly 80 yieldably urges the pusher element 72 forwardly into contact with the rearmost product 68 or 70 to maintain all of such products in a side-by-side relationship within a forwardly extending row thereof, with the forwardmost product disposed adjacent the front of the compartment 64 or 66 of the carrying assembly 14, the front ends of which compartments 64 and 66 are closed by a front wall 90 that is preferably in the form of a transparent plastic plate to permit viewing of the forwardmost product 68 or 70 within the compartment 64 or 66 by a customer through the transparent display window of the frontal door conventionally provided upon such class of vending machines (but not illustrated in the drawings). The front walls 90 are conveniently mounted on the carrying assembly 14 through reception of the lower part thereof in an accommodating groove 92 formed in the depending front flange structure 46 on the carrying assembly 14. The flange structure 46 may also conveniently include a downwardly and forwardly inclined portion 94 for displaying pricing information or the like.

The pusher element 72 for providing a yieldable biasing force for urging the products 68 or 70 forwardly within the compartments 64 or 66 in which they are stored, although needed for assuring proper positioning of the products within the compartments for reliable dispensing of the former from the latter, could constitute a real nuisance to servicing personnel during loading of the carrying assembly 14 with products, if the yieldable force exerted by the pusher element 72 continued during loading operations, as is typical in most magazine storage type dispensing equipment employing some form of product biasing structure. In the apparatus 10, however, means are provided in an economical and constructionally simple manner for preventing the cited nuisance from occuring during loading in the form of depending ear structure 96 on the base assembly 16 disposed in a position to be engaged by the depending projection 76 of the pusher element 72 when the latter is moved forwardly. As the carrying assembly 14 is shifted from its normal operating position depicted in FIG. 4, the projection 76 of the pusher assembly 72 will engage the ear structure 96 and be blocked against further forward movement, regardless of the quantity of products 68 or 60 in the corresponding chamber 64 or 66, so that the forward biasing pressure that would otherwise be exerted upon the products 68 or 70 by the frontal portion 74 of the pusher element 72 is relieved during further forward movement of the carrying assembly 14 and while it remains in its fully extended forward position for loading. As will also be observed as significant, upon rearward movement of the carrying assembly 14 toward and into its normal operating position, the rearmost of the products 68 or 70 that have been loaded into each compartment 64 or 66 will eventually engage the frontal portion 74 of the corresponding pusher element 72, moving the latter rearwardly and restoring the forward biasing force exerted by the spring assembly 80 through the pusher element 72.

As those skilled in the art will appreciate, with products of the class of primary interest in connection with this invention, when such products are stored in side-by-side relationship in a horizontal row and subjected to a compressive biasing force from one end of the row, there may be a tendency for individual products or groups thereof to rise or "buckle" or to "shingle" or otherwise create a jamming condition. The conventional approach to providing vertical confinement of the type of products of primary interest within channel-like storage compartments therefor has been to provide so-called "product hold-down" flanges extending inwardly from the tops of the side walls of the compartment (such as from the tops of the partitions 56); that approach, however, significantly narrows the width of the opening at the top of each compartment, with the result that the operation of loading products into the compartment will require inserting the products through the opening with their length dimension turned from the transverse dimension of the compartment itself and then manually twisting or otherwise reorienting the products once they have been inserted into the compartment, which is both inconvenient and time consuming and may result, if servicing personnel are careless, in compartments actually being loaded with products in a jammed condition or in dispositions from which jamming is highly probable. In the product carrying assembly 14, the function of retaining the product 68 or 70 in a properly inter-related row-like arrangement is taken care of by the provision of an overlying cover assembly generally designated 100. The cover assembly includes a main, flat, plate-like top 102 adapted to cover the otherwise open tops of all of the compartments 64 and 66, which is provided with a channel flange 104 along the front margin thereof disposed for normally overlying the front cross-piece 52 of the carrying assembly 14 and certain other structures hereinafter described as associated with such cross-piece 52. The cover top 102 is secured to the front section 106 of a hinge assembly generally designated 108 having a pivotal axis defined by a transversely extending leg 110 of a pair of L-shaped rods 112 disposed adjacent opposite sides of the carrying assembly 14. The rear section of the hinge 108 is provided by the rearwardly extended branches 114 of the rods 112 which are slideably received for forward or rearward movement within brackets 116 mounted atop the rear cross-piece 50 of the carrying assembly 14. Thus, the cover top 110 is shiftably mounted for forward or rearward movement upon the carrying assembly 14. A tension spring 118 is interconnected between a point 120 on the top cover 102 that is disposed forwardly of the pivotal axis provided by the legs 110 of the rods 112 and an opposite connecting point rearwardly of such pivotal axis, such as at 122 on the rear cross-piece 50 of the carrying assembly 14. At the front of the top cover 102, beneath the channel 104 are side plates 124 having an upwardly and forwardly directed notch 126 formed therein and adapted to receive latching pins 128 extending inwardly from the side walls 48 of the carrying assembly 14. As will be apparent from FIG. 2, when the cover assembly is lowered into the position illustrated, the notches 126 of the latching plates 124 will receive the latching pins 128 and the biasing action of the spring 118 will urge the entire cover assembly 100 rearwardly to latch the same in the position illustrated, which is the normal condition that prevails during operation. When the carrying assembly 14 is extended to its loading position depicted in FIG. 4, however, the cover assembly 100 may be conveniently and quickly unlatched by servicing personnel merely by grasping the channel portion 104 thereof and pulling it forwardly to release the latch, then swinging it upwardly and rearwardly about the pivotal axis provided by the hinge legs 110 until the cover assembly 100 has been swung to a position completely clearing the open tops of the compartments 64 and 66 for loading with products. After the loading operation has been completed, the service person need merely swing the cover assembly 100 back to its normal closing position, while pulling the same slightly forwardly against the biasing force of the spring 118 to permit the slots 126 of the latching plates 124 to receive the latching pins 128, then releasing the cover assembly 100 to permit it to return to its normal and fully latched condition under the influence of the rearwardly biasing action of the spring 118.

It should be perceived at this point that our improved construction of the product carrying assembly 14, including its shiftable mounting upon a fixed base assembly 16, its shiftably hinged cover assembly 100, its open topped compartments 64 and 66 and its automatically deactivatable pusher elements 72, provide significant advantages as compared with earlier devices for similar purposes, with respect to storage efficiency, loading convenience, simplicity of organization and economy of fabrication.

The remaining portions of the apparatus 10 are concerned primarily with providing for the reliable and selective dispensing of the forwardmost product 68 or 70 from any of the compartments 64 and 66. The components employed for such purpose are primarily associated with the base assembly 16, with one exception hereinafter noted.

Although driving power could presumably be otherwise derived, if desired, the base assembly 16 is most conveniently provided with a single, electric motor, drive unit 130 mounted on one side wall 30 thereof and operably coupled with a rotatable main shaft 132 supported within the base assembly 16 and extending transversely beneath all of the compartments 64 and 66. The drive unit 130 is adapted to be activated by the electrical control circuit of the host vending machine whenever a product is to be dispensed from any of the compartments 64 or 66 of the carrying assembly 14. A cam 134 on the shaft 132 and an associated electrical switch 136 coupled with the control circuitry of the machine provide for rotation of the shaft 132 through a full but single revolution thereof during each activation of the drive unit 130.

A rocker shaft 138 extends transversely across the base assembly 16 forwardly of the main shaft 132 and carries thereon an operating lever 140 for each of the compartments 64 and 66. Each lever 140 has a bifurcated rearward extension presenting follower arms 142 and 144 respectively above and below the main shaft 132. The main shaft 132 carries an eccentric drive cam 146 between and oppositely engaged by the arms 142 and 144 of each of the levers 140. Thus, as best seen from FIG. 3, starting from the position shown in the latter, the portion of each of the levers 140 forwardly of the rocker shaft 138 will first be swung upwardly, then swung back downwardly to the position illustrated, during each activation of the drive unit 130.

Each lever 140 carries a solenoid 148 coupled with the product selection circuitry of the host machine and is adapted to temporarily raise its armature 150 to the position illustrated in FIG. 3 (see FIG. 4 for a showing of the armature 150 in its inactive position) whenever the solenoid 148 is activated by customer selection of the corresponding product type. Although the control circuitry of the host machine may otherwise provide for such function, a lockout switch 152 may be provided to be actuated whenever its associated solenoid 148 is activated to prevent more than one of the solenoids 148 ever being fraudulently activated in response to a single coinage deposit and product purchasing operation of the machine by a customer.

A pawl carrying crank 154 is pivotally carried by each lever 140 upon a pivot pin 156 and is operably coupled with the armature 150 of the corresponding solenoid 148 for being swung in a counter-clockwise direction from the position shown in FIG. 4 to the position shown in FIG. 3 in response to each activation of the corresponding solenoid 148. A pawl assembly 158 having upper and lower projections 160 and 162 is pivotally carried by each crank 154 by a pivot pit 164 on its upper part. An over center spring 166 is carried by each lever 140 and appropriately coupled with the corresponding pawl 158 in such manner as to yieldably retain the latter at one or the other of the extreme positions (respectively illustrated in FIGS. 3 and 4) it may be moved into through activation of the corresponding solenoid 148 or the other means influencing its position hereinafter described.

When the solenoid 148 corresponding to a particular product selection is activated, as illustrated in FIG. 3, the crank 154 will be swung counter-clockwise by the armature 150, thereby shifting the pawl 158 to the position illustrated in which contact of the lower projection 162 with the rear surface of a guide bracket 168 rotates the pawl 158 counter-clockwise to a position in which it is yieldably retained by the spring 166 with the upper projection 160 thereof extending into a cavity 170 of a vertically reciprocal ejector member 172 slidably mounted within the guide assembly 168. In such condition, the upper projection 160 is disposed to engage a downwardly facing shoulder 174 at the top of the cavity 170 for lifting the ejector member 172 upwardly during the upward portion of the oscillating travel of the lever 140 marking the initial phase of each dispensing cycle. The base means 16 is provided with an opening 176 directly overlying the ejector member 172 and the open top end of the guide 168, and a cooperating opening 178 is provided on the bottom of the carrying assembly 14, both of such openings 176 and 178 being directly beneath the forwardmost product 68 or 70 in the corresponding compartment 64 or 66 of the carrying assembly 14 when the latter is in its normal operating position.

During such initial upward movement of the lever 140 for the selected product type, the upper projection 160 of the pawl 158 lifts the ejector member 172 into contact with the bottom of the forwardmost product of the selected type, thereby raising the latter above the front wall 90 of the corresponding compartment 64 or 66, from which lifted position such product may fall off of the front of the carrying assembly 14 for travel to a customer access zone of the host machine in conventional manner. It will be noted that, while the ejector member 172 is in such raised condition thereof, it blocks the next adjacent product in the involved compartment 64 or 66 from advancing to a position over the openings 176 and 178 until the ejector member 172 has been lowered to its normal standby position.

To facilitate the discharge of the forwardmost product from a compartment 64 or 66 as a consequence of its being raised from the latter by the ejector member 172, there is provided an upwardly swingable deflector 180 for each of the compartments 64 or 66 in normally overlying relaionship with the forwardmost product in the latter. Such deflectors 180 are pivotly mounted upon the front cross piece 52 by a pin 182 and are yieldably biased downwardly by a spring 184 whose tension is adjustable by means of a wing nut 186. During lifting of a forwardmost product by the ejector member 172, the corresponding deflector 180 swings upwardly against the bias of its spring 184 and then assists in moving the fully raised product off of the front of the carrying assembly 14 by virtue of the biasing force of the spring 184.

After completion of the dispensing of a product, the continued rotation of the main shaft 132 and the cam 146 swing the forward portion of the lever 140 back downwardly toward its standby position illustrated in FIG. 3. As the lever 140 thus swings downwardly, the corresponding pawl 158 is lowered and the corresponding ejector member 172 is also restored to its normal standby position, which can be assured by engagement of the upper projection 160 with an underlying boss 188 within the cavity 170. As the pawl 158 is thus lowered, its lower projection 162 contacts a camming projection 190 extending rearwardly from the ejector guide assembly 168, which engagement moves the pawl 158 and the crank 154 back to the normal standby position thereof illustrated in FIG. 4, thereby readying the dispensing mechanisms associated with the base assembly 16 for the next active operation thereof when a product of corresponding type is selected. It is believed apparent from FIG. 4 that, during raising of levers 140 whose solenoids 148 are not activated, the corresponding pawls 158 will merely be raised and lowered along a path such that the corresponding ejector member 172 is not in contact or moved by the projection 160 of such pawl 158.

Those experienced in working with dispensing mechanisms of the general class involved will appreciate not only the minimization of parts and general simplicity of the improved dispensing mechanism incorporated into the apparatus 10, but also the manner in which its straight forward mode of operation tends to assure a high degree of reliability.

It is further believed generally apparent to those skilled in the art that the improved construction for product storing and dispensing apparatus provided by this invention accomplishes its objective in a manner providing a number of related advantages over prior constructions. It should be equally apparent, however, that various minor modifications might be made from the details of the preferred embodiment chosen for illustrating the principals of the invention, without departing from the real spirit and essence of the invention. Accordingly, it is to be understood that the scope of the invention should be determined from the claims which follow, when the latter are interpreted to include subject matter in the nature of mechanical equivalents of things recited therein.

We claim:

1. In product storing and dispensing apparatus especially adapted for use in handling relatively rigid, elongate products, such as generally cylindrical rolls of mints, generally parallelepipedal packages of gum, or the like, and especially suited for employment in vending machines of types having a cabinet provided with an internal chamber, internal structure for supporting a number of typically drawer-like, product storage and dispensing assemblies in typically closely spaced, vertically overlying relationship to each other within said chamber, and a normally closed, frontal door typically including a transparent area to permit viewing by customers of products carried by said assemblies and adapted to be opened to provide service personnel with access to the front of said chamber:

base means adapted to be carried by said supporting structure and to remain within said chamber during both normal operation of said machine and the loading into the latter of products to be stored therein for dispensing therefrom, said base means including a stop means;

product carrying means for providing an elongate generally horizontally extending, open-top compartment having an end wall, side walls and means for providing bottom support surface zones for receiving from above and shiftably supporting therein elongate products of a corresponding type with their longitudinal dimension disposed substantially transversely to the longitudinal dimension of said compartment;

means for shiftably mounting said product carrying means upon said base means, with the longitudinal dimension of said compartment extending generally parallel to the front-to-rear dimension of said chamber, said end wall being disposed at the front extremity of said compartment, and said product carrying means being movable when said door is opened between a rearward, operating position entirely within said chamber and a forward, loading position extending out the front of said chamber;

means on said product carrying means for engaging and yieldably urging a rearmost product within said compartment forwardly to maintain all products within said compartment in side-by-side, successively interengaging relationship with the forwardmost product in engagement with said end wall when said product carrying means is in said operating position thereof, said urging means including a product pusher element, and spring means operably coupled with said element for yieldably biasing the latter in a forward direction along said compartment, a part of said element being automatically engagable with said stop means for blocking forward movement of said element relative to said base means and shifting the position of said element rearwardly with respect to said compartment whenever said product carrying means is moved away from its operative position toward its loading position, and whereby the forward urging force of said element is automatically removed from any products remaining within said compartment before said cover means may be moved to its open position, said element being automatically retained in a retracted position to facilitate the loading of products whenever said product carrying means is moved to its loading position, and the forward biasing force of said element is automatically restored to all products within said compartment upon returning said product carrying means to its operating position after restoring said cover means to its closed position;

cover means;

means for shiftably mounting said cover means upon said product carrying means for movement between an open position for exposing the open top of said compartment when said product carrying means is in its loading position and a closed position adjacently overlying all products disposed rearwardly of said forwardmost product within said compartment for preventing said rearward products from shingling or rising above the top of said compartment when they are subjected to the force of said urging means;

ejector means;

means for shiftably mounting said ejector means upon said base means for movement between a standby position clear of said product carrier means and the path of said movement of the latter and an ejecting position for engaging and lifting said forwardmost product out of said compartment to dispense the same from said product carrier means when the latter is in its operating position; and selectively operable means operably coupled with said ejector means for moving the latter from said standby position to said ejecting position and back to said standby position thereof when said product carrying means is in its operating position.

2. Apparatus as set forth in claim 1, wherein:

said mounting means for said cover means includes hinge means having a pair of pivotally coupled sections of which one is secured to said cover means, means for shiftably mounting the other of said hinge sections upon said product carrying means for movement forwardly or rearwardly relative to the latter, means for yieldably urging said cover means rearwardly, and releasable latching means for automatically latching said cover means when it is urged rearwardly by said urging means associated therewith while it is in its closed position and for automatically unlatching said cover means when it is pulled forwardly from its closed and latched position against the force of said urging means associated therewith.

3. Apparatus as set forth in claim 2, wherein:

said ejector means includes a member which is reciprocable along an upright path, and said selectively operable means for said ejector means includes a lever pivotally mounted on said base means, means for selectively actuating said lever through an operating cycle swinging the same from a standby position to an actuated position and back to said standby position thereof, a pawl pivotally mounted on said lever for movement between an inactive position and an active position for operably coupled engagement with said ejector member for raising the latter during movement of said lever from its standby position to its actuated position, means for selectively shifting said pawl from its inactive position to its active position prior to movement of said lever from its standby position to its actuated position, and means on said base means engageable with said pawl for restoring the latter to its inactive position during movement of said lever from its actuated position back to its standby position.

4. Apparatus as set forth in claim 3, wherein:

there is provided over-center spring means for yieldably urging said pawl into one or the other of its inactive and active positions, and said means for selectively shifting said pawl includes a selectively energizable solenoid having a shiftable part, and means for operably coupling said shiftable part with said pawl.

5. In product storing and dispensing apparatus especially adapted for use in handling relatively rigid, elongate products, such as generally cylindrical rolls of mints, generally parallelepipedal packages of gum, or the like, and especially suited for employment in vending machines of types having a cabinet proviced with an internal chamber, internal structure for supporting a number of typically drawerlike, product storage and dispensing assemblies in typically closely spaced, vertically overlying relationship to each other within said chamber, and a normally closed, frontal door typically including a transparent area to permit viewing by customers of products carried by said assemblies and adapted to be opened to provide service personnel with access to the front of said chamber;

base means adapted to be carried by said supporting structure and to remain within said chamber during both normal operation of said machine and the loading into the latter of products to be stored therein for dispensing therefrom;

product carrying means for providing an elongate generally horizontally extending, open-top compartment having an end wall, side walls and means for providing bottom support surface zones for receiving from above and shiftably supporting therein elongate products of a corresponding type with their longitudinal dimension disposed substantially transversely to the longitudinal dimension of said compartment;

means for shiftably mounting said product carrying means upon said base means, with the longitudinal dimension of said compartment extending generally parallel to the front-to-rear dimension of said chamber, said end wall being disposed at the front extremity of said compartment, and said product carrying means being movable when said door is opened between a rearward, operating position entirely within said chamber and a forward, loading position extending out the front of said chamber;

means on said product carrying means for engaging and yieldably urging a rearmost product within said compartment forwardly to maintain all products within said compartment in side-by-side, successively interengaging relationship with the forwardmost product in engagement with said end wall when said product carrying means is in said operating position thereof;

cover means;

means for shiftably mounting said cover means upon said product carrying means for movement between an open position for exposing the open top of said compartment when said product carrying means is in its loading position and a closed position adjacently overlying all products disposed rearwardly of said forwardmost product within said compartment for preventing said rearward products from shingling or rising above the top of said compartment when they are subjected to the force of said urging means;

ejector means including a member which is reciprocable along an upright path;

means for shiftably mounting said ejector means upon said base means for movement between a standby position clear of said product carrier means and the path of said movement of the latter and an ejecting position for engaging and lifting said forwardmost product out of said compartment to dispense the same from said product carrier means when the latter is in its operating position; and selectively operable means operably coupled with said ejector means for moving the latter from said standby position to said ejecting position and back to said standby position thereof when said product carrying means is in its operating position, said selectively operable means for said ejector means includes a lever pivotally mounted on said base means, means for selectively actuating said lever through an operating cycle swinging the same from a standby position to an actuated position and back to said standby position there, a pawl pivotally mounted on said lever for movement between an inactive position and an active position for operably coupled engagement with said ejector member for raising the latter during movement of said lever from its standby position to its actuated position, means for selectively shifting said pawl from its inactive position to its active position prior to movement of said lever from its standby position to its actuated position, and means on said base means engageable with said pawl for restoring the latter to its inactive position during movement of said lever from its actuated position back to its standby position.

6. Apparatus as set forth in claim 1, wherein:

said product carrying means provides a plurality of said compartments in side-by-side relationship to each other, there are a plurality of said product urging means respectively associated with said plurality of compartments, said cover means is a generally plate-like structure common to all of said compartments, there are a plurality of said ejector means and means for shiftably mounting the same upon said base means respectively associated with sid plurality of compartments, and there are a plurality of said selectively operable means respectively associated with said plurality of ejector means.

7. Apparatus as set forth in claim 6, wherein:

each of said urging means includes a product pusher element, and spring means operably coupled with said element for yieldably biasing the latter in a forward direction along the corresponding compartment, said base means is provided with stop means, and a part of each of said elements is automatically engageable with said stop means for blocking forward movement of said element relative to said base means and shifting the position of said element rearwardly with respect to said compartment whenever said product carrying means is moved away from its operative position toward its loading position, whereby the forward urging force of said elements is automatically removed from any products remaining within the corresponding of said compartments before said cover means may be moved to its open position, said elements are automatically retained in a retracted position to facilitate the loading of products whenever said product carrying means is moved to its loading position, and the forward biasing force of said elements is automatically restored to all products within the corresponding of said compartments upon returning said product carrying means to its operating position after restoring said cover means to its closed position.

8. Apparatus as set forth in claim 7, wherein:

each of said compartments is provided with a longitudinal slot along its bottom, and each of said pusher elements includes a portion thereof projecting downwardly through said slot of the corresponding compartment.

9. Apparatus as set forth in either of claims 6 or 7, wherein:

said mounting means for said cover means includes hinge means having a pair of pivotally coupled sections of which one is secured to said cover means, means for shiftably mounting the other of said hinge sections upon said product carrying means for movement forwardly or rearwardly relative to the latter, means for yieldably urging said cover means rearwardly, and releasable latching means for automatically latching said cover means when it is urged rearwardly by said urging means associated therewith while it is in its closed position and for automatically unlatching said cover means when it is pulled forwardly from its closed and latched position against the force of said urging means associated therewith.

10. Apparatus as set forth in claim 9, wherein:

each of said ejector means includes a member which is reciprocable along an upright path, and said selectively operable means for each of said ejector means includes a lever pivotally mounted on said base means and actuatable through an operating cycle swinging the same from a standby position to an actuated position and back to said standby position thereof, a pawl pivotally mounted on said lever for movement between an inactive position and an active position for operably coupled engagement with said ejector member for raising the latter during movement of said lever from its standby position to its actuated position, means for selectively shifting said pawl from its inactive position to its active position prior to movement of said lever from its standby position to its actuated position, and means on said base means engagable with said pawl for restoring the latter to its inactive position during movement of said lever from its actuated position back to its standby position, and there being means common to all of said levers for selectively actuating all of same through said operating cycle thereof concurrently.

11. Apparatus as set forth in claim 10, wherein:

there is provided over-center spring means for yieldably urging each of said pawls into one or the other of its inactive and active positions, and said means for selectively shifting each of said pawls incldes a selectively energizable solenoid having a shiftable part, and means for operably coupling said shiftable part with said pawl.

12. Apparatus as set forth in either of claims 6 or 7, wherein:

each of said ejector means includes a member which is reciprocable along an upright path, and said selectively operable means for each of said ejector means includes a lever pivotally mounted on said base means and actuatable through an operating cycle swinging the same from a standby position to an actuated position and back to said standby position thereof, a pawl pivotally mounted on said lever for movement between an inactive position and an active position for operably coupled engagement with said ejector member for raising the latter during movement of said lever from its standby position to its actuated position, means for selectively shifting said pawl from its inactive position to its active position prior to movement of said lever from its standby position to its actuated position, and means on said base means engagable with said pawl for restoring the latter to its inactive position during movement of said lever from its actuated position back to its standby position, and there being means common to all of said levers for selectively actuating all of same through said operating cycle thereof concurrently.

13. Apparatus as set forth in claim 12, wherein:

there is provided over-center spring means for yieldably urging each of said pawls into one or the other of its inactive and active positions, and said means for selectively shifting each of said pawls includes a selectively energizable solenoid having a shiftable part, and means for operably coupling said shiftable part with said pawl.

14. Apparatus as set forth in claim 1, wherein:

said mounting means for said cover means includes hinge means having a pair of pivotally coupled sections of which one is secured to said cover means, means for shiftably mounting the other of said hinge sections upon said product carrying means for movement forwardly or rearwardly relative to the latter, means for yieldably urging said cover means rearwardly, and releasable latching means for automatically latching said cover means when it is urged rearwardly by said urging means associated therewith while it is in its closed position and for automatically unlatching said cover means when it is pulled forwardly from its closed and latched position against the force of said urging means associated therewith, and said yieldable urging means for said cover means including a tension spring oppositely connected with said cover means forwardly of the pivotal axis of said hinge means and with a portion of said product carrying means rearwardly of said axis of said hinge means, whereby said tension spring assists in swinging said cover means from its closed to its opened position and in releasably retaining the same in the latter.

* * * * *